United States Patent [19]

Anderson et al.

[11] 3,977,326

[45] Aug. 31, 1976

[54] COMPOSITE CARTRIDGE CASING AND METHOD OF ASSEMBLY

[75] Inventors: Raymond A. Anderson, Easton; John J. Scanlon, Monroe, both of Conn.

[73] Assignee: Remington Arms Company, Inc., Bridgeport, Conn.

[22] Filed: Feb. 6, 1975

[21] Appl. No.: 547,519

[52] U.S. Cl. ..... 102/43 P; 102/44

[51] Int. Cl.[2] ..... F42B 7/06

[58] Field of Search ..... 102/43, 43 P, 44

[56] References Cited

UNITED STATES PATENTS

| | | | |
|---|---|---|---|
| 3,099,958 | 8/1963 | Daubenspeck et al. | 102/43 P |
| 3,690,256 | 9/1972 | Schnitzer | 102/44 |
| 3,842,739 | 10/1974 | Scanlon et al. | 102/43 P |

*Primary Examiner*—Verlin R. Pendegrass

*Attorney, Agent, or Firm*—John H. Lewis, Jr.; Nicholas Skovran; William L. Ericson

[57] ABSTRACT

A composite cartridge casing having a plurality of component parts, which may be of dissimilar materials such as metal and plastic, includes a tubular casing body formed with a mouth portion for receiving a projectile and with a breech portion which has a cylindrical interior wall extending forwardly from an opening in its base. An annular bridge insert member has a forward cup portion which is receivable through the base opening into the casing body, a rearward skirt portion of reduced diameter, and a frusto-conical central portion connecting the cup and skirt portions. After insertion of the bridge insert, the breech portion of the casing body is deformed and reduced to engage the frusto-conical and skirt portions, thereby securing the assembly and forming an extraction groove around the base of the casing. A head assembly is then attached to the base to complete the casing.

6 Claims, 5 Drawing Figures

COMPOSITE CARTRIDGE CASING AND METHOD OF ASSEMBLY

BACKGROUND AND BRIEF DESCRIPTION OF THE INVENTION

This invention relates to cartridge cases, and more particularly to composite cartridge cases made up of a plurality of component parts, including a tubular casing body having a mouth portion for receiving a projectile, and a separate head assembly for reinforcing the base of the cartridge case and mounting a primer component. The principal purpose of such a composite construction is to permit the use of dissimilar materials for the components, usually comprising plastic for the casing body and metal for the head assembly, thereby conserving the relatively scarce and expensive metal. Examples of such composite cases are described and claimed, for example, by U.S. Pat. No. 3,745,924 issued July 17, 1973 to John J. Scanlon, and by U.S. patent application Ser. NO. 320,328, filed on Jan. 2, 1973 by H. Jackson Hale, and now Pat. NO. 3,874,294 both of which are assigned to the owner of this application. The mouth portion of the case may be integrally formed in the casing body, or may be a separate insert, usually of metal. A composite case of the latter type is described and claimed by U.S. Pat. No. 3,842,739 issued Oct. 22, 1974 to John J. Scanlon et al., and also assigned to the owner of this application.

The general objects of the present invention are to provide an improved method for manufacturing composite cartridge casings, and a casing which exhibits a high degree of structural integrity against the development of cracks or other mechanical failures under the high pressures and temperatures developed by firing the cartridge. Other objects and advantages of the invention will appear as the following description proceeds.

Briefly stated, according to a preferred mode of practice of the improved method, a tubular casing body is formed, preferably from a suitable synthetic resin or plastic material according to well-known procedures, with an open-ended breech portion having an interior cylindrical wall extending to an opening at a base end of the casing. A rearwardly-facing shoulder is formed about the interior wall in spaced-apart relation to the base. The casing body is also formed with a mouth portion at a forward end, dimensioned to receive a selected bullet or projectile in mechanically-secured gas-sealing relation; the mouth portion may be molded integrally in the casing body, or may comprise a separate tubular metallic insert.

A bridge insert member is formed, also preferably from a suitable synthetic resin or plastic material, with a forward cup portion having a cylindrical outer wall which is of a diameter to be slidable into the interior of the casing through the base opening, and with a rearward annular skirt portion of a reduced diameter. It preferably also has a central frusto-conical portion connecting the cup and skirt portions, a primer-receiving recess in the skirt portion, and a transverse wall portion formed centrally with a flash hole to communicate the primer recess with the powder charge to be contained in the body of the casing.

The bridge insert is inserted through the base opening into abutment with the shoulder on the interior wall, which is preferably spaced somewhat farther from the base of the casing than the length of the bridge insert, to provide a suitable length of overhanging material in the breech portion of the casing for the ensuing step. This consists of deforming, preferably by cold-working, a rearward region of the breech portion of the casing to reduce its diameter and bring it into conforming circumferential engagement with the exterior surfaces of the frusto-conical and skirt portions of the bridge insert, thereby securing the assembly of the casing body and bridge insert. The outer surface of the breech portion thus assumes a form similar to that of the bridge insert, and provides an extraction groove at the base of the casing. A head assembly, preferably formed of metal and including a reinforcing sleeve, an extraction rim, and a cup member, is then attached to the base of the casing according to methods known per se.

DESCRIPTION OF THE DRAWING

While the specification concludes with claims particularly pointing out the subject matter which is regarded as the invention, it is believed that a clearer understanding may be gained from the following description of a preferred embodiment and mode of practice thereof, referring to the accompanying drawing, in which:

DESCRIPTION OF THE PREFERRED EMBODIMENT AND MODE OF PRACTICE

Figure 1:
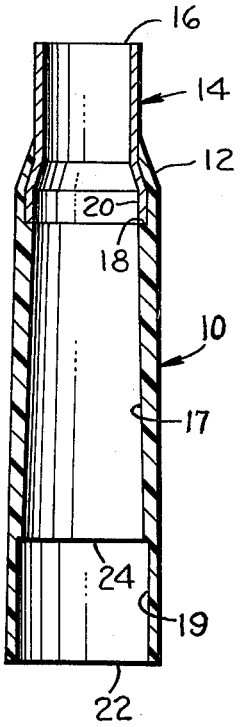
FIG. 1 is a cross-sectional view showing a preferred formation of a casing body.

FIG. 1 illustrates preferred forms of a tubular casing body 10 and a tubular mouth insert member 14 which are components of the improved composite cartridge casing. The mouth insert member may be formed integrally with the casing body if desired, as by molding from a suitable synthetic resin or plastic material by well-known procedures. However, the illustrated embodiment employs a separate metallic mouth insert and a plastic casing body, as this combination affords better retention of the bullet or projectile, places the center of gravity of the cartridge farther forward so that the compositecasing cartridge may have a dynamic behaviour like that of a standard all-metal cartridge and therefore cooperate more satisfactorily with a standard ejection mechanism, and allows for the possiblity of using relatively low-cost plastic material for the casing body, since the strength and temperature-resistance requirements are at a maximum in the mouth region.

The tubular mouth insert 14 has a circular mouth 16 dimensioned to receive a selected projectile (not shown) in gas-sealing mechanically-secured relation thererin, and terminates rearwardly in an outwardly-flared circumferential shoulder 20. The casing body 10 is formed about the mouth insert 14, preferably by a known insert molding process, to include a conventional tapered neck 12, a tubular interior chamber wall 17 terminating forwardly in a circumferential shoulder 18 abutting the mouth insert 14 to continue its interior chamber wall smoothly to the rear, a rearwardly-facing circumferential shoulder 24, and a cylindrical interior wall 19 extending through a breech portion of the body casing and terminating in an opening at its base end 22.

Figure 2:
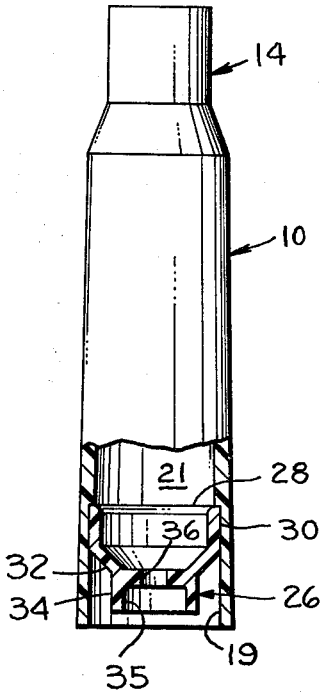
FIG. 2 is a view in side elevation and partially in section showing the casing body and a bridge insert member assembled therein.

FIG. 2 illustrates the formation of an annular bridge insert member 26, which is preferably also formed of a suitable synthetic resin or plastic material. The bridge insert 26 includes a forward annular cup portion 30, having a cylindrical exterior surface of a diameter which permits it to be inserted through the opening in the base 22 into conforming circumferential engagement with the cylindrical interior wall 19. The cup portion 30 terminates forwardly in a circumferential rim 28, which seats against the shoulder 24 to locate the bridge insert with respect to the casing body. The cup portion then cooperates with the interior wall 17 and the mouth insert 14 to define a chamber 21 for housing a conventional propellant (not shown). A rearwardly-extending annular skirt portion 34 is of a smaller diameter than the cup portion 30, and is connected to it by a frusto-conical central portion 32. A transverse wall portion 33 is formed centrally with a flash hole 36, providing access between the chamber 21 and a recess 35 formed in the skirt portion 34 for receiving a battery cup and primer.

Figure 3:
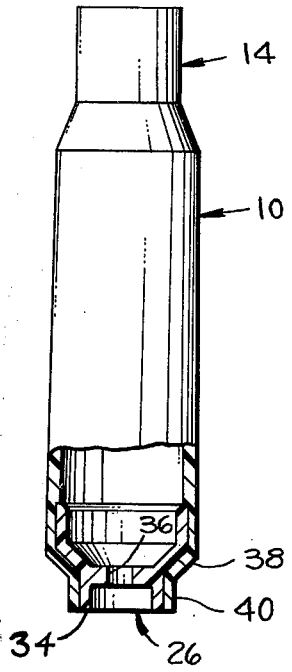
FIG. 3 is a view in side elevation and partially in section showing the deformation of a portion of the casing body to secure the assembly of FIG. 2.

After the bridge insert 26 is seated as shown in FIG. 2, the region of the casing body 10 extending rearwardly from the junction of the cup portion 30 with the central portion 32 is cold-worked by well-known procedures to reduce its diameter and deform it into tight sealing engagement with the skirt portion 34, as shown in FIG. 3. Before it is deformed, the breech portion of the casing body 10 extends sufficiently far to the rear of the bridge insert 26, as shown in FIG. 2 to provide material for covering the bridge insert to its base end, forming a frusto-conical section 38 and a cylindrical skirt section 40 in the terminal region of the casing body.

Figure 4:
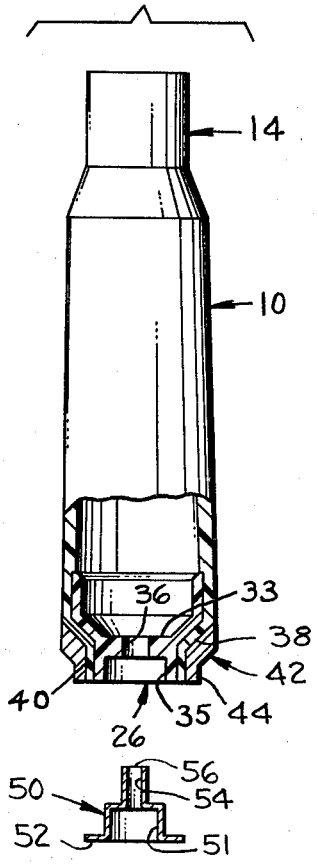
FIG. 4 is a view in side elevation and partially in section showing a reinforcing ring assembled with the casing, and a flanged cup member prior to its assembly with the casing.
Figure 5:
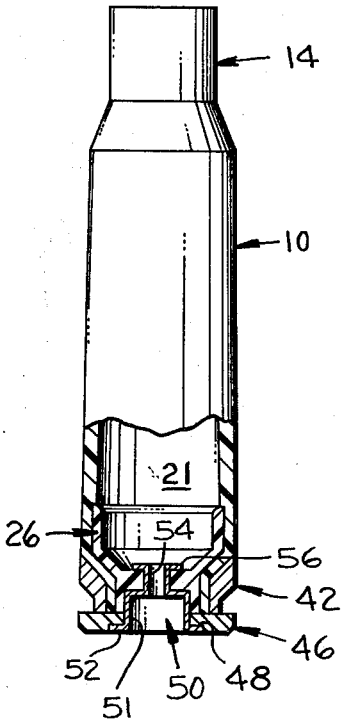
FIG. 5 is a view in side elevation and partially in section showing the completed casing, with the flanged cup member and an extraction rim member in assembled relation.

A metallic head assembly is next attached to the casing in steps shown in FIGS. 4 and 5. A multiple-component assembly is illustrated, including a reinforcing sleeve 42, a flanged cup 50, and an extraction rim 46, as more fully described by the aforementioned U.S. patent application Ser. No. 320,328, but it will be understood that some or all of these parts may be integrally formed as a unit if desired. The reinforcing sleeve 42 is assembled with the casing first, being received with a tight fit over the skirt section 40 of the casing, and is formed at its forward end with a frusto-conical recess 43 mating with the frusto-conical section 38 of the casing. The flanged cup 50, shown prior to assembly with the casing in FIG. 4, has a cylindrical recess 51 into which a conventional primer (not shown) is later inserted when the cartridge casing is to be loaded. A circumferential flange 52 extends about the cup 50, and a tubular extension 54 extends forwardly into an elongated tip 56 for subsequent flaring. As appears in FIG. 5, an extraction rim 46 is placed against the base of the casing 10, after which the cup 50 is inserted through a central opening in the rim into the recess 35. The flange 52 seats in a circumferential recess 48 formed about the opening in the rim 46, serving to secure the rim to the base of the casing. The extension 54 is received through the flash hole 36 with its elongated tip 56 initially extending somewhat forwardly of the transverse wall 33, into the chamber 21. To secure the head assembly, a punch or die is inserted through the mouth 16 of the casing and used to flare the tip 56 outwardly as shown in FIG. 5, so that it engages the forward surface of the transverse wall 33.

The casing is then complete, and ready to be loaded in a conventional manner with a suitable primer, propellant, and projectile. The reduced-diameter rear portion 44 of the reinforcing sleeve 42 cooperates with the rim 46 to provide an extraction groove of conventional form.

It has been found that when a cartridge casing is molded or drawn with an initially-cylindrical interior chamber to permit the formation of the base region by means of tools inserted through the mouth of the casing, and the mouth region is subsequently cold-worked to produce the final reduced-diameter forms of the mouth and tapered neck regions, there is a tendency for the mouth and neck to develop cracks when fired, and there is also an inadequate retention of the projectile. Our improved method permits the mouth and neck regions to be molded to final form initially, and eliminates any need for subsequent cold-working of these portions of the casing. At the same time, our method requires only a moderate amount of cold-working of the base region, which is largely filled by the bridge insert, so that it successfully avoids cracking problems in this region as well. Our improved cartridge casing has been tested successfully in 7.62 mm and 30–06 calibers, and has passed firing tests under pressure of 80,000 psi under "cook-off" conditions in the hot chambers of repeating firearms. At ambient temperatures as low as −65° F., it has not shown the development of base cracks.

What is claimed is:

1. The method of forming a composite cartridge casing which comprises the steps of:

forming a tubular casing body with a mouth portion of a first diameter at a forward end thereof for receiving a selected projectile in gas-sealing mechanically-secured relation therein, and with an open-ended breech portion having an interior cylindrical wall of a second diameter greater than said first diameter and extending to a rearward base end thereof;

forming a bridge insert member with a forward annular cup portion of substantially said second diameter to be received conformably in circumferential engagement with said interior wall of said breech portion, and with a rearward annular skirt portion of reduced diameter;

then inserting said bridge insert member through said breech portion into circumferential engagement of said cup portion thereof with said interior wall of said breech portion, with said skirt portion extending within said breech portion rearwardly from said cup portion toward said base end of said breech portion;

and then permanently deforming said breech portion to reduce its diameter in a region thereof spaced rearwardly from said cup portion and circumferentially spaced about said skirt portion, thereby to engage said region conformably about said skirt portion to securely retain said bridge insert member in assembly with said casing body.

2. The method recited in claim 1, in which the step of forming said bridge insert member includes forming a substantially frusto-conical central portion interconnecting said cup portion and said skirt portion, and the step of deforming said breech portion of said casing body includes engaging said rearward region of said breech portion conformably about said frusto-conical portion and said skirt portion.

3. The method recited in claim 1, in which the step of forming said casing body includes forming a circumferential rearwarldy-facing shoulder extending circumferentially about said interior wall thereof at a forward end of said breech portion, and the step of forming said bridge insert member includes forming a circumferential rim thereabout; said rim being engaged against said shoulder by said inserting step.

4. The method recited in claim 1, in which the step of forming said bridge insert member includes forming a transverse wall portion therein and forming a flash hole through said transverse wall portion; together with the further steps of forming a head assembly conformably receivable against said base end of said casing body and having a tubular extension receivable through said flash hole, assembling said head assembly with said casing body, and flaring said tubular extension into circumferential engagement with said transverse wall portion to secure said head assembly to said casing body.

5. A composite cartridge case comprising:

a tubular casing body having a mouth portion of a first diameter at a forward end thereof formed to receive a selected projectile in gas-sealing mechanically-secured relation therein, and a breech portion adjacent to a rearward base end thereof, said breech portion having an interior circumferentially-extending wall of a second diameter greater than said first diameter;

a bridge insert member received conformably within said breech portion in circumferential engagement with said interior wall thereof, and including a forward annular cup portion and a rearward annular skirt portion of a diameter less than that of said cup portion;

a region of said breech portion lying circumferentially about said skirt portion and rearwardly of said cup portion being permanently deformed to a reduced diameter and conformably engaging said skirt portion therein to securely retain said bridge insert member in assembly with said casing body;

said bridge insert member including a transverse wall portion formed with a flash hole; together with a head assembly received conformably against said base end of said casing body and having a tubular extension received through said flash hole and flared outwardly into circumferential engagement with said transverse wall portion of said bridge insert member.

6. A cartridge casing as recited in claim 5, said casing body including an interior circumferentially-extending wall having a circumferential rearwardly-facing shoulder, said bridge insert member being formed with a circumferential rim abutting against said shoulder.

* * * * *